US005636712A

United States Patent [19]

Müller et al.

[11] Patent Number: 5,636,712

[45] Date of Patent: Jun. 10, 1997

[54] APPARATUS FOR DRIVING A SELF-PROPELLED ELEVATOR

[75] Inventors: Wolfgang Müller, Meggen; Christoph Liebetrau, Menziken; Utz Richter, Ebikon; Jürgen Kästle, Udligenswil, all of Switzerland; Albrecht Morlok, Horb; Helmut Heizmann, Stuttgart, both of Germany

[73] Assignee: Inventio AG, Hergiswil, Switzerland

[21] Appl. No.: 438,774

[22] Filed: May 11, 1995

[30] Foreign Application Priority Data

May 13, 1994 [EP] European Pat. Off. ..... 94107439

[51] Int. Cl.[6] ..... B66B 9/02

[52] U.S. Cl. ..... 187/249; 187/250; 187/404; 187/410

[58] Field of Search ..... 187/249, 250, 187/404, 410, 411

[56] References Cited

U.S. PATENT DOCUMENTS

| | | | |
|---|---|---|---|
| 353,458 | 11/1886 | Murtaugh | 187/249 |
| 1,730,974 | 10/1929 | Higbee | 187/404 X |
| 3,101,130 | 8/1963 | Bianca | 187/404 X |
| 3,381,541 | 5/1968 | Thireau et al. | 187/250 X |
| 5,464,072 | 11/1995 | Muller | 187/249 |

FOREIGN PATENT DOCUMENTS

| | | | |
|---|---|---|---|
| 2658180 | 8/1991 | European Pat. Off. | 187/250 |
| 0595122 | 5/1994 | European Pat. Off. . | |
| 1251925 | 10/1967 | Germany . | |
| 6932326 | 8/1969 | Germany . | |
| 3523187 | 1/1987 | Germany . | |
| 211466 | 8/1994 | Japan | 187/250 |
| 1184781 | 10/1985 | U.S.S.R. | 187/250 |
| 1263605 | 10/1986 | U.S.S.R. | 187/250 |

*Primary Examiner*—Karen B. Merritt
*Assistant Examiner*—Scott L. Lowe
*Attorney, Agent, or Firm*—Howard & Howard Atty.

[57] ABSTRACT

A friction wheel drive apparatus for a self-propelled elevator car movable in an elevator shaft can be mounted on the top side or bottom side of the car. The drive apparatus is connected with a counterweight by a force transmission device for balancing the car weight and a portion of the conveyed load. The force transmission device is fastened to and guided at the drive apparatus such that a force generated by the counterweight, the weight of the car and the weight of the conveyed load is applied as a contact pressure to urge a friction wheel of the drive apparatus against a travel track surface.

18 Claims, 2 Drawing Sheets

APPARATUS FOR DRIVING A SELF-PROPELLED ELEVATOR

BACKGROUND OF THE INVENTION

The present invention relates generally to a self-propelled elevator system and, in particular, to a drive apparatus for a self-propelled elevator car.

It is known in elevator systems to utilize a counterweight to balance out the car weight and a portion of the conveyed load. The use of a counterweight reduces the driving power required to move the car. Such a reduction is of particular significance in self-propelled elevators because, in addition to the car weight, the weight of the entire drive equipment mounted on the car adds to the required driving power.

The German patent specification DE 35 23 187 shows a self-propelled building elevator having a drive which is mounted on the top side of a car. A driven friction wheel and a counter wheel are pressed by spring force against opposite sides of a vertically extending travel track. In order to balance the weight of the car and the drive as well as a portion of the load in the car, the car is connected with a counterweight by means of cables guided in the elevator shaft by way of a roller mounted at the top of the shaft. One end of the cables is fastened to the counterweight and the other end is fastened underneath the car.

The German patent specification 1 251 925 shows a self-propelled elevator car with a friction wheel drive which utilizes the splaying principle. Guide wheels and drive wheels are mounted at the comers of the upper side of the car, wherein the drive wheels are pressed against the travel track by a spring force. A cable has one end fastened in the center of the upper side of the car and extends over a pair of rollers mounted at the top of the shaft. The other end of the cable is connected to a counterweight. If the cable breaks, a car holding device is triggered.

Both of the above described drive systems have as a common feature the active application of contact pressure of the friction wheels on the travel track exerted by an appropriately arranged compression spring. Upon a reduction in the friction wheel diameter due to wear, there is a reduction in the contact pressure force applied by the driven friction wheel against the travel track as a consequence.

SUMMARY OF THE INVENTION

The present invention concerns an apparatus for driving a self-propelled elevator car along a generally vertically extending travel track in an elevator shaft. The drive apparatus includes a fulcrum means for attaching to a top side or bottom side of an elevator car, a guide link pivotally attached to the fulcrum means, a pressure wheel rotatably mounted on the guide link, a counterweight and a force transmission means connected between the guide link and the counterweight for applying a force representative of a weight of the counterweight to the guide link. The guide link extends at an angle of less than 90° to horizontal and the force generates a contact pressure in a generally horizontal direction urging the pressure wheel against a generally vertically extending surface of a travel track in an elevator shaft through which the elevator car travels. The invention has several embodiments in which another pressure wheel is rotatably mounted on the same guide link or on another guide link, movable or fixed, for engaging another travel track.

The advantages achieved by the present invention are that no special active contact pressure generating devices are needed and that the necessary contact pressure against the travel track is always present independent of the degree of wear of the driven pressure wheels.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
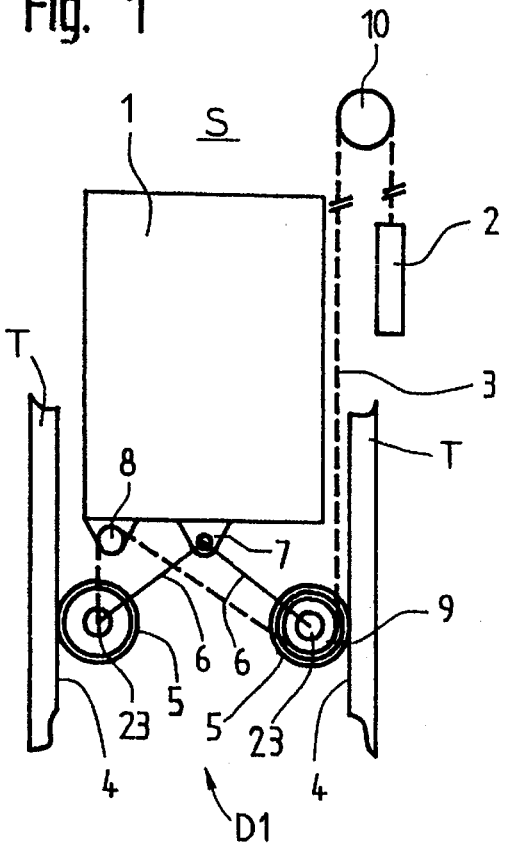
FIG. 1 is a schematic front elevation view of a self-propelled elevator car having a splaying friction wheel drive apparatus mounted at the bottom of the car with two movable guide links in accordance with the present invention.

There is shown in the FIG. 1 a self-propelled elevator car 1 vertically movable in an elevator shaft S and having a splaying friction wheel drive apparatus D1 mounted at a bottom side of the car. The drive apparatus D1 includes a pair of pressure wheels in the form of friction wheels 5 each attached to an associated one of a pair of axles 23. Each of the axles 23 is rotatably mounted at a lower end of an associated one of a pair of movable guide links 6. The movable guide links 6 each have an upper end pivotally attached to a fulcrum means 7 which is mounted at a center portion of the bottom of the car 1. The guide links 6 extend downwardly and outwardly in opposite directions to side edges of the car 1 from the upper ends to the lower ends. At least one of the friction wheels 5 is connected to a drive motor, not illustrated, for rotation. In the FIG. 1, only two of the friction wheels 5 are visible. However, the wheels 5 can be mounted adjacent the front edge of the car bottom and another pair of the friction wheels can be mounted in a similar manner at the rear edge of the car bottom. The friction wheels 5 each run on an associated vertically extending lateral travel track surface 4 of tracks T which are mounted on or formed on the side walls of the elevator shaft S. The frictional engagement necessary for the drive of the car 1 is produced by a defined contact pressure of the friction wheels 5 on the travel track surfaces 4.

In order to balance the weight of the car 1, the weight of the drive D1 and a portion of the conveyed load, the car is connected with a counterweight 2 by an elongated flexible force transmission means 3 which is guided over a deflecting roller 10 rotatably mounted, for example, at the top of the elevator shaft S. The force transmission means 3 has one end fastened to the car 1 at the left-hand axle 23, is guided vertically upwardly and over a deflector 8 fastened to the bottom of the car, extends obliquely downwardly to the right and under a deflector 9 mounted on the right-hand axle 23, extends vertically upwardly and over the deflecting roller 10 and finally extends downwardly to an opposite end attached to the counterweight 2. The force transmission means 3 preferably consists of at least one wire cable. However, it can also be in the form of chains or belts, and any metal, alloy or synthetic fiber can be used as the construction material.

Due to the illustrated manner of the fastening and guidance of the force transmission means 3, the counterweight 2 generates a tension force through the force transmission means which force is applied to the lower ends of the guide links 6 to urge the friction wheels 5 upwardly and outwardly and apply a contact pressure in a generally horizontal direction against the travel track surfaces 4. This contact pressure urging force is increased by the useful car load representing the weight of the car 1, the weight of the drive D1 and the weight of the load conveyed by the car whereby a weight-dependent component is added to the contact pressure through the links 6.

Figure 2:
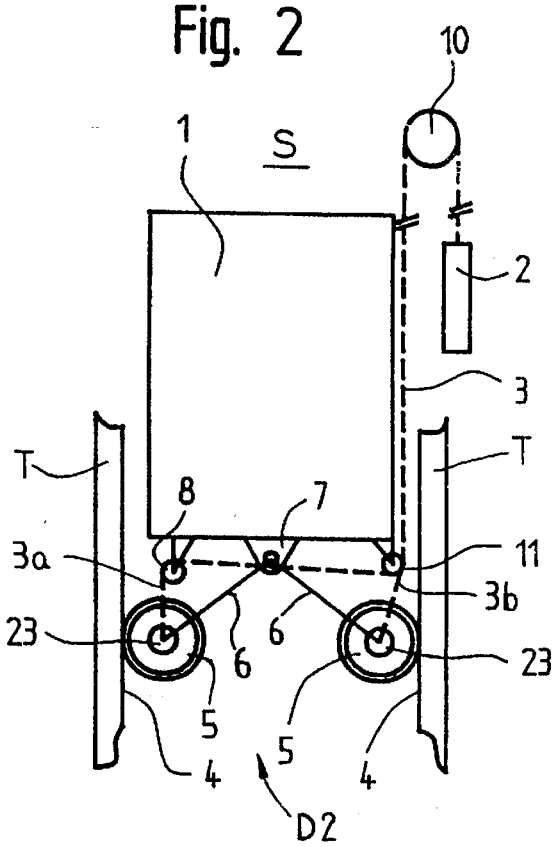
FIG. 2 is a schematic front elevation view of an alternate embodiment of the apparatus shown in the FIG. 1.

In the FIG. 2, there is shown an alternate embodiment of the drive apparatus D1 shown in the FIG. 1 in which the one end of the force transmission means 3 consists of at least two portions. An alternate embodiment drive apparatus D2 includes a first portion 3*a* of the force transmission means 3 having one end fastened at the left-hand axle 23, extending upwardly and over the deflector 8 and then extending generally horizontally to the right and partially around a deflector 11 mounted at a lower right-hand corner of the car 1. Another or second portion 3*b* of the one end of the force transmission means 3 has one end fastened at the right-hand axle 23 and is guided somewhat obliquely upwardly and partially around the deflector 11 where an opposite end is joined together with an opposite end of the first portion 3*a*. Due to the illustrated manner of the fastening and guidance of the force transmission means 3, the counterweight 2 generates a tension force urging the lower ends of the guide links 6 and the rotatably attached friction wheels 5 upwardly and outwardly against the travel track surfaces 4 which adds to the contact pressure generated by the useful car load acting through the guide links. The balancing-out of forces between the two portions 3*a* and 3*b* of the force transmission means 3 is provided by the usual resilient fastening of the free ends to the axles 23.

Figure 3:
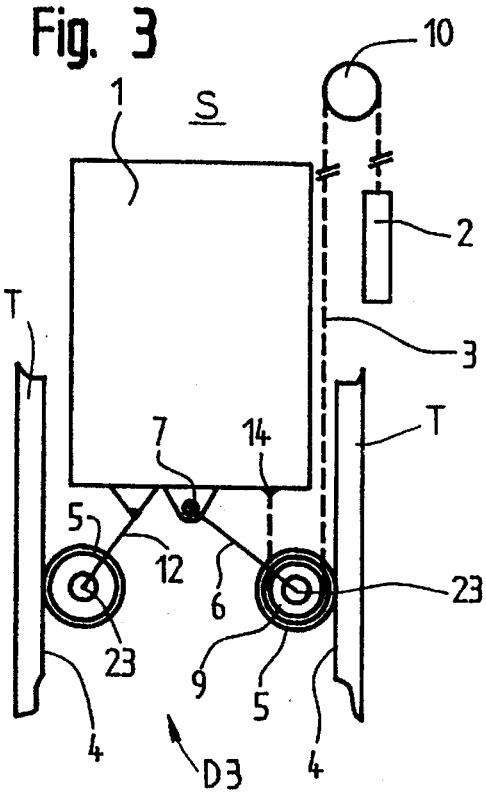
FIG. 3 is a schematic front elevation view of a self-propelled elevator car having a splaying friction wheel drive apparatus mounted at the bottom of the car with one movable guide link and one fixed guide link in accordance with another embodiment of the present invention.

In the FIG. 3, there is shown another embodiment of the present invention in which only the right-hand movable guide link 6 is used in a splaying friction drive apparatus D3. A rigid guide link 12 has an lower end attached to the left-hand axle 23 and extends inwardly and upwardly to an upper end fixed to the bottom side of the car 1. The one end of the force transmission means 3 is attached at a fastening point 14 at the underside of the car 1. The force transmission means 3 extends from the fastening point 14, under the deflector 9 on the right-hand axle 23 and upwardly to and over the deflecting roller 10. Due to the illustrated manner of the fastening and guidance of the force transmission means 3, the counterweight 2 generates a tension force which urges the guide link 6 and the rotatably attached friction wheel 5 upwardly and outwardly against the travel track 4 which adds to the useful car load dependent contact pressure.

Figure 4:
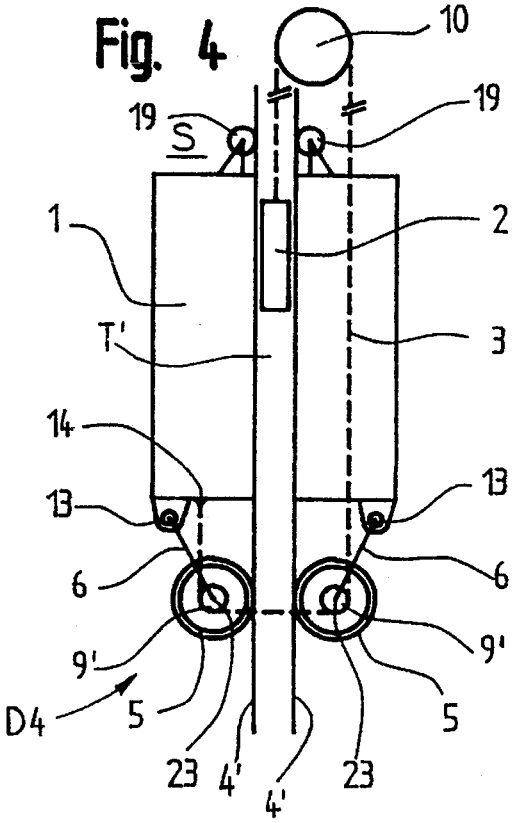
FIG. 4 is a schematic side elevation view of a self-propelled elevator car having a clamping friction wheel drive apparatus mounted at the bottom of the car with two movable guide links in accordance with a fourth embodiment of the present invention.

In the FIG. 4, there is shown a fourth embodiment of the present invention in the form of a clamping friction wheel drive apparatus D4. The friction wheels 5 are urged against opposite surfaces 4' of a travel track T', which track is constructed as a hollow profile with the counterweight 2 movable therein. The upper ends of the movable guide links 6 are pivotally attached to the bottom side edges of the car 1 by separate fulcrum means 13. The links 6 extend inwardly and downwardly to the lower ends which are attached to the wheels 5 and the axles 23. A pair of guide rollers 19 are mounted at the top of the car 1 to engage the opposite travel track surfaces 4'. The one end of the transmission means 3 is attached to bottom of the car 1 at the fastening point 14, extends downwardly and under a deflector 9' attached to the left-hand axle 23, extends horizontally to the right and under another one of the deflectors 9' attached to the right-hand axle 23 and extends upwardly to and over the deflecting roller 10. Due to the illustrated manner of the fastening and guidance of the force transmission means 3, the counterweight 2 generates a tension force which urges the guide links 6 and the rotatably attached friction wheels 5 upwardly and inwardly against the travel track surfaces 4' which adds to the useful car load dependent contact pressure applied through the links.

Figure 5:
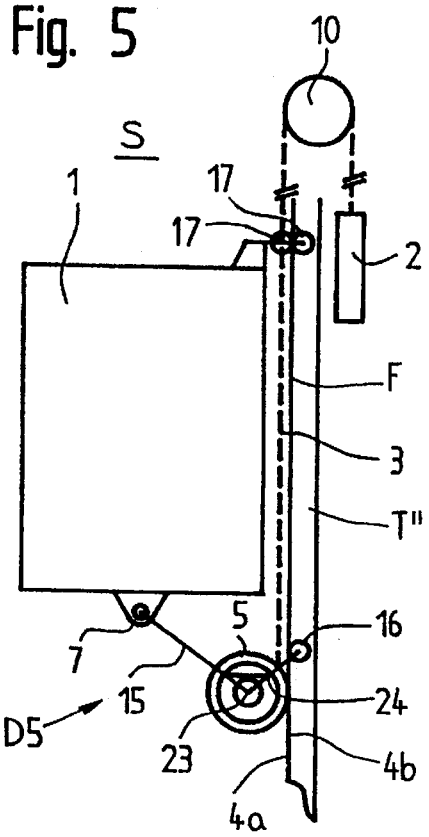
FIG. 5 is a schematic front elevation view of a self-propelled elevator car having a clamping friction wheel drive apparatus mounted at the bottom of the car with a single movable guide link in accordance with a fifth embodiment of the present invention.

In the FIG. 5, a self-propelled elevator car 1 is shown in a so-called "rucksack arrangement". A clamping friction wheel drive apparatus D5 in accordance with a fifth embodiment of the present invention is mounted underneath the car 1 and operates on the clamping principle utilized by the drive apparatus D4 shown in the FIG. 4. However, a difference from the preceding embodiment is that a triangular guide link has a longer arm 15 which has a lower end on which the friction wheel 5 and the axle 23 are rotatably mounted and extends upwardly and inwardly to an upper end pivotally attached to the fulcrum means 7. The triangular guide link includes a shorter arm 24 having lower end attached to the lower end of the arm 15 and extending upwardly and outwardly to an upper end on which a pressure wheel in the form of a counterpressure roller 16 is rotatably mounted. The car 1 has a pair of guide rollers 17 mounted on the top side thereof. A travel track T" can, for example, be constructed with a double-T profile having a flange F with a first travel track surface 4*a* facing the car 1 and a second travel track surface 4*b* on an opposite side of the flange. Thus, the friction wheel 5 and one of the rollers 17 run on the surface 4*a* and the counterpressure roller 16 and the other one of the guide rollers 17 run on the surface 4*b*. One end of the force transmission means 3 is fastened at about the center of the shorter arm 24 and the force transmission means extends upwardly and over the deflecting roller 10 to the counterweight 2. The fastening and guidance of the force transmission means 3 urges the arm 15 and the rotatably attached friction wheel 5 upwardly and outwardly against the travel track surface 4*a* to add to the contact pressure generated by the useful car load.

Figure 6:
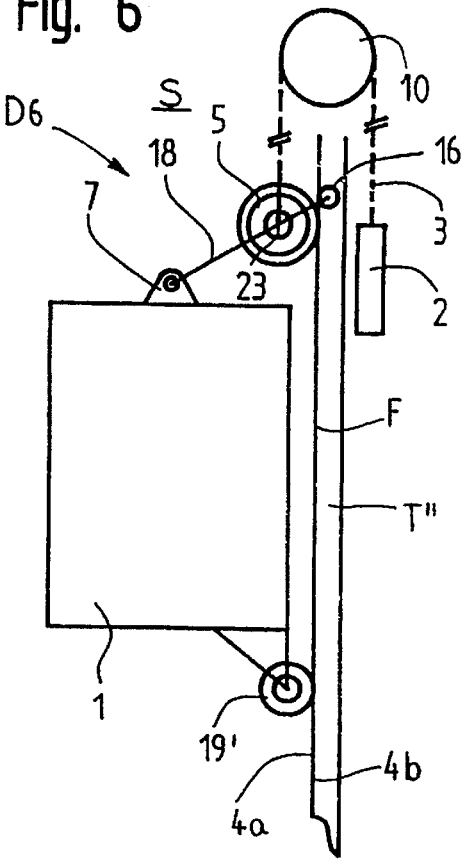
FIG. 6 is a schematic front elevation view of a self-propelled elevator car having a clamping friction wheel drive apparatus mounted at the top of the car with a single movable guide link in accordance with a sixth embodiment of the present invention.

The apparatus according to the present invention shown in the FIG. 6 is similar to the apparatus shown in the FIG. 5, with the difference that a sixth embodiment clamping friction wheel drive apparatus D6 is mounted on the top of the car 1. A guide link in the form of a lever 18 has a lower end pivotally attached to the fulcrum means 7 and extends upwardly and outwardly to an upper end on which the counterpressure roller 16 is rotatably mounted to engage the surface 4*b*. The friction wheel 5 and axle 23 are rotatably mounted about two thirds of the length of the link 18 to the right. A guide roller 19' is mounted at the underside of the car 1 to engage the travel track surface 4*a*. The force transmission means 3 has one end fastened directly to the axle 23 and extends upwardly and over the roller 10. With respect to contact pressure urging the friction wheel 5 against the travel track surface 4*a*, the same effect is achieved here as by the drive apparatus D5 shown in the FIG. 5.

Figure 7:
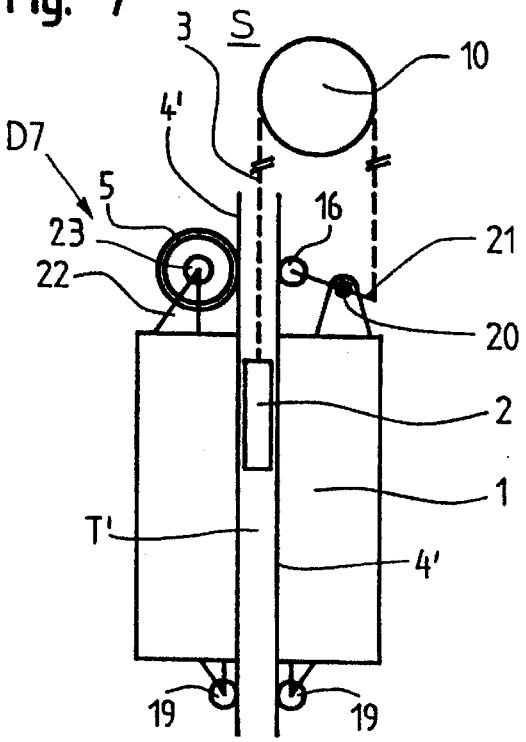
FIG. 7 is a schematic side elevation view of a self-propelled elevator car having a rigid clamping friction wheel drive apparatus mounted at the top of the car with a single movable guide link and a counter roller in accordance with a seventh embodiment of the present invention.

In the FIG. 7, there is shown a clamping friction wheel drive apparatus D7 according to a seventh embodiment of the present invention in which the friction wheel 5 and the counterpressure roller 16 are separated. The friction wheel 5 is rotatably mounted in a fixed beating support 22 attached to the top of the car 1 and engages one travel track surface 4' of the travel track T'. The counterpressure roller 16 is rotatably attached to an upper end of a guide link in the form of a lever 21 which extends downwardly and outwardly to a central portion pivotally mounted at a fulcrum means 20 attached to the top of the car 1. A pair of the guide rollers 19 are mounted at the bottom of the car 1 to engage the opposite travel track surfaces 4'. The force transmission means 3 has one end attached to a lower end of the guide link lever 21 and extends upwardly and over the roller 10. The fastening and guidance of the force transmission means 3 causes a contact pressure by urging the friction wheel 5 and the counterpressure roller 16 against the opposite surfaces 4' of the travel track T'. The total contact pressure depends upon the useful car load and the lever ratio of the guide link lever 21.

Figure 8:
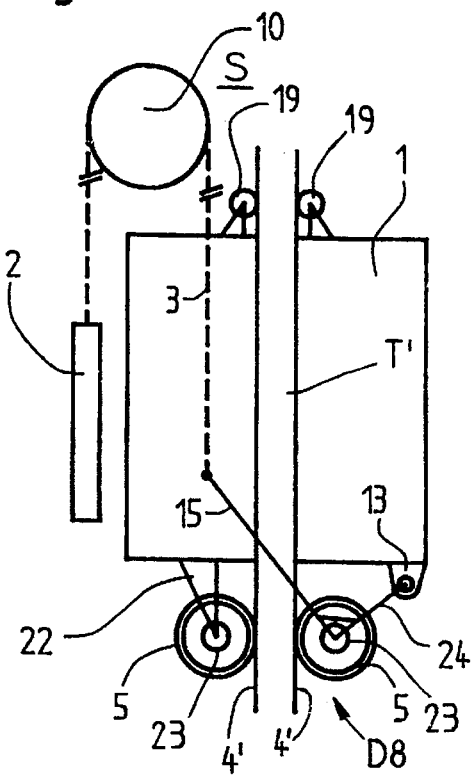
FIG. 8 is a schematic side elevation view of a self-propelled elevator car having a clamping friction wheel drive apparatus mounted at the bottom of the car with a triangular guide link in accordance with an eighth embodiment of the present invention.

Another clamping friction wheel drive apparatus D8 according to an eighth embodiment of the present invention is illustrated in the FIG. 8. The bearing support 22 and rotatably attached friction wheel 5 shown in the FIG. 7 have been moved to the bottom of the car 1 to engage one of the travel track surfaces 4'. The movable triangular guide link shown in the FIG. 5 has the upper end of the shorter arm 24 pivotally connected to the fulcrum 13 which is attached to the bottom of the car 1. The friction wheel 5 rotatably attached at the junction of the arms 15 and 24 engages the other one of the surfaces 4'. The upper end of the longer arm 15 is attached to the one end of the force transmission means 3. The friction wheels 5 are urged onto engagement with the adjacent travel track surfaces 4' by the tension force generated by the counterweight 2, wherein the contact pressure is absorbed by the left-hand friction wheel 5 which functions as a counterpressure roller. Either one or both of the friction wheels 5 can be driven.

The function of the drive apparatus according to the present invention is evident to a large extent from the preceding description of the embodiments shown in the drawings. The location of the fastening and the manner of the guidance of the force transmission means 3 results in the desired weight-dependent urging of the friction wheels 5 against the travel track surfaces 4, 4' and 4*a*. The weight-dependent contact pressure improves the frictional engagement for higher conveyed loads.

As mentioned above, cables, chains or belts formed of any desired materials can be used for the force transmission means 3. The deflectors 8, 9 and 11 can be rotatably mounted or, because it can be assumed with some certainty that sliding movements for the force balance can take place, the deflectors could be fixed with a corresponding sliding surface construction and possibly lubrication.

The angles of the guide links 6 to the horizontal can be so chosen that the splaying and clamping force components, the contact pressure force components, which act horizontally on the travel track surfaces 4, 4' and 4*a* and are generated solely by the useful car load, are sufficient to hold the car securely in every position of travel without the additional contact pressure components generated by the counterweight 2 through the force transmission means 3. In the embodiments of the present invention discussed above, the guide links 6, 12, 15, 18 and 21 each have a longitudinal axis which extends at a angle of less than 90° with respect to horizontal and the force transmission means 3 has a longitudinal axis which extends generally vertically. Thus, the longitudinal axis of each of the guide links extends at a angle of less than 90° with respect to the longitudinal axis of the force transmission means 3.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for driving a self-propelled elevator car along a generally vertically extending travel track in an elevator shaft comprising:

a fulcrum means for attaching to an elevator car;

a guide link pivotally attached to said fulcrum means;

a pressure wheel rotatably mounted on said guide link at a rotation axis of said pressure wheel;

a counterweight; and a force transmission means connected between said guide link and said counterweight for applying a force representative of a weight of said counterweight to said guide link whereby when said fulcrum means is attached to an elevator car, said guide link extends at an angle of less than 90° to horizontal and said force generates a contact pressure in a generally horizontal direction urging said pressure wheel against a generally vertically extending surface of a travel track in an elevator shaft through which the elevator car travels.

2. The apparatus according to claim 1 wherein said guide link and said force transmission means each have a longitudinal axis and an angle between said longitudinal axis of said force transmission means and said longitudinal axis of said guide link is less than 90°.

3. The apparatus according to claim 1 wherein said fulcrum means is attached to a central portion of one of a top side and a bottom side of the elevator car.

4. The apparatus according to claim 1 wherein said fulcrum means is attached to an edge portion of one of a top side and a bottom side of the elevator car.

5. The apparatus according to claim 1 wherein said guide link has one end pivotally attached to said fulcrum means.

6. The apparatus according to claim 1 wherein said guide link has a central portion pivotally attached to said fulcrum means.

7. The apparatus according to claim 1 wherein said force transmission means extends about a portion of a deflector attached to said guide link.

8. The apparatus according to claim 1 wherein said force transmission means and said guide link each have an end, said ends being connected together.

9. The apparatus according to claim 1 wherein said guide link has a central portion and said force transmission means has an end attached to said central portion of said guide link.

10. An apparatus for driving a self-propelled elevator car along a generally vertically extending travel track in an elevator shaft comprising:

a fulcrum means for attaching to a bottom side of an elevator car;

at least one guide link having an end pivotally attached to said fulcrum means and having an opposite end;

a pressure wheel rotatably mounted on said opposite end of said one guide link;

a counterweight; and a flexible force transmission means connected between said one guide link and said counterweight for applying a force representative of a weight of said counterweight to said one guide link whereby when said fulcrum means is attached to an elevator car, said guide link extends at an angle of less than 90° to horizontal and said force generates a contact pressure in a generally horizontal direction urging said pressure wheel against a generally vertically extending surface of a travel track in an elevator shaft through which the elevator car travels.

11. The apparatus according to claim 10 including another guide link having an end pivotally attached to said fulcrum means and having an opposite end, another pressure wheel rotatably mounted on said opposite end of said another guide link, a first deflector attached to said opposite end of said one guide link, a second deflector for attachment to the bottom side of the elevator car and said force transmission means having an end attached to said opposite end of said another guide link and extending partially around said first and second deflectors whereby when said fulcrum means and said second deflector are attached to the elevator car, said force generates a contact pressure in a generally horizontal direction urging said pressure wheel mounted on said another guide link against a generally vertically extending surface of another travel track in the elevator shaft through which the elevator car travels.

12. The apparatus according to claim 10 including another guide link having an end pivotally attached to said fulcrum means and having an opposite end, another pressure wheel rotatably mounted on said opposite end of said another guide link, a first deflector for attachment to the bottom side of the elevator car, a second deflector for attachment to the bottom side of the elevator car and said force transmission means having an end separated into a first end portion and a second end portion, said first end portion being attached to said opposite end of said another guide link and extending partially around said first deflector, said second end portion being attached to said opposite end of said one guide link and extending partially around said second deflector whereby when said fulcrum means and said deflectors are attached to the elevator car, said force generates a contact pressure in a generally horizontal direction urging said pressure wheel mounted on said another guide link against a generally vertically extending surface of another travel track in the elevator shaft through which the elevator car travels.

13. The apparatus according to claim 10 including another guide link having an end for attachment to the bottom of the elevator car and having an opposite end, another pressure wheel rotatably mounted on said opposite end of said another guide link, a deflector attached to said opposite end of said one guide link and said force transmission means having an end for attachment to the bottom of the elevator car and extending partially around said deflector.

14. The apparatus according to claim 10 including another guide link having an end pivotally attached to said fulcrum means and having an opposite end, another pressure wheel rotatably mounted on said opposite end of said another guide link, a first deflector attached to said opposite end of said one guide link, a second deflector attached to said opposite end of said another guide link and said force transmission means having an end for attachment to the bottom of the elevator car and extending partially around said first and second deflectors whereby when said fulcrum means and said end of said force transmission means are attached to the elevator car, said force generates a contact pressure in a generally horizontal direction urging said pressure wheel mounted on said another guide link against another generally vertically extending surface of the travel track in the elevator shaft through which the elevator car travels.

15. An apparatus for driving a self-propelled elevator car along a generally vertically extending travel track in an elevator shaft comprising:

a fulcrum means for attaching to an elevator car;

a guide link being pivotally attached to said fulcrum means;

a pressure wheel rotatably mounted on said guide link;

a counterweight; and a flexible force transmission means connected between said guide link and said counterweight for applying a force representative of a weight of said counterweight to said guide link whereby when said fulcrum means is attached to an elevator car, said guide link extends at an angle of less than 90° to horizontal and said force generates a contact pressure in a generally horizontal direction urging said pressure wheel against a generally vertically extending surface of a travel track in an elevator shaft through which the elevator car travels.

16. The apparatus according to claim 15 wherein said guide link has a central portion extending between one end and an opposite end, said one end of said guide link being pivotally attached to said fulcrum means, said pressure wheel being rotatably mounted on said central portion of said guide link, and said force transmission means having an end attached to said central portion of said guide link, and including counterpressure wheel rotatably mounted on said opposite end of said guide link whereby said force generates a contact pressure in a generally horizontal direction urging said counterpressure wheel against another generally vertically extending surface of the travel track in an elevator shaft through which the elevator car travels.

17. The apparatus according to claim 15 wherein said guide link has a central portion extending between one end and an opposite end, said central portion of said guide link being pivotally attached to said fulcrum means, said pressure wheel being a counterpressure roller rotatably mounted on said one end of said guide link, and said force transmission means having an end attached to said opposite end of said guide link, and including another pressure wheel for rotatable mounting on the elevator car whereby when said fulcrum means is attached to and said another pressure wheel is mounted on the elevator car, said force generates a contact pressure in a generally horizontal direction urging said another pressure wheel against another generally vertically extending surface of the travel track in an elevator shaft through which the elevator car travels.

18. The apparatus according to claim 15 wherein said guide link has a central portion extending between one end and an opposite end, said one end of said guide link being pivotally attached to said fulcrum means, said pressure wheel being rotatably mounted on said central portion of said guide link, and said force transmission means having an end attached to said opposite end of said guide link, and including another pressure wheel for rotatable mounting on the elevator car whereby when said fulcrum means is attached to and said another pressure wheel is mounted on the elevator car, said force generates a contact pressure in a generally horizontal direction urging said another pressure wheel against another generally vertically extending surface of the travel track in an elevator shaft through which the elevator car travels.

* * * * *